US008026672B2

(12) United States Patent
Chen et al.

(10) Patent No.: US 8,026,672 B2
(45) Date of Patent: Sep. 27, 2011

(54) LIGHT EMITTING DEVICE

(75) Inventors: Farn Hin Chen, Ipoh (MY); Tak Meng Cheang, Bayan Lepas (MY); Boon Keat Tan, Gelugor (MY)

(73) Assignee: Avago Technologies ECBU IP (Singapore) Pte. Ltd., Singapore (SG)

( * ) Notice: Subject to any disclaimer, the term of this patent is extended or adjusted under 35 U.S.C. 154(b) by 469 days.

(21) Appl. No.: 12/323,419

(22) Filed: Nov. 25, 2008

(65) Prior Publication Data

US 2010/0127629 A1 May 27, 2010

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 37/02*** | (2006.01) |
| ***H05B 39/04*** | (2006.01) |
| ***H05B 41/36*** | (2006.01) |
| ***G05F 1/00*** | (2006.01) |

(52) U.S. Cl. ..... 315/193; 315/297; 315/320; 315/315

(58) Field of Classification Search ... 315/185 R–185 S, 315/312, 291–311

See application file for complete search history.

(56) References Cited

U.S. PATENT DOCUMENTS

| | | | | |
|---|---|---|---|---|
| 5,895,302 | A | 4/1999 | Chen-Lun et al. | |
| 6,949,771 | B2 | 9/2005 | Yoganandan | |
| 7,405,433 | B2 | 7/2008 | Chew | |
| 7,883,248 | B2 * | 2/2011 | Kitamura | 362/473 |
| 2007/0102718 | A1 | 5/2007 | Takekuma et al. | |

OTHER PUBLICATIONS

Shatil, "Packaging Challenges of High-Power LEDs for Solid State Lighting", File creation date stamp Jul. 24, 2003.

* cited by examiner

*Primary Examiner* — Jacob Y Choi
*Assistant Examiner* — Henry Luong

(57) ABSTRACT

A light emitting device is disclosed herein. An embodiment of the light emitting device comprises a first plurality of light emitters comprising a first group and a second group, wherein the first group is connectable in series to the second group. A first driver is connected to the first group. A second driver is connectable to the second group. A first voltage comparator is coupled to the first driver, wherein the voltage comparator compares the voltage of the first driver to a predetermined voltage. The light emitting device is in a first state when the voltage of the first driver is below the predetermined voltage. The light emitting device is in a second state when the voltage of the first driver is greater than the predetermined voltage. The light emitting device is in the first state, the first group is connected in series with the second group to form a series circuit between the first driver and a reference voltage. When the light emitting device is in the second state, the first group is connected between the first driver and the reference voltage and the second group is connected between the second driver and the reference voltage.

16 Claims, 2 Drawing Sheets

LIGHT EMITTING DEVICE

BACKGROUND

Many light emitting devices use drivers to drive light emitters, such as light emitting diodes (LEDs) or other light sources. The forward voltage of LEDs varies with temperature and possibly other factors. As the forward voltage increases, the voltage required to be supplied by the drivers to drive the LEDs increases. In many devices, the voltage required by the LEDs can increase beyond the capability of the drivers. The result is low intensity light emission or no light emission.

DETAILED DESCRIPTION

Figure 1:
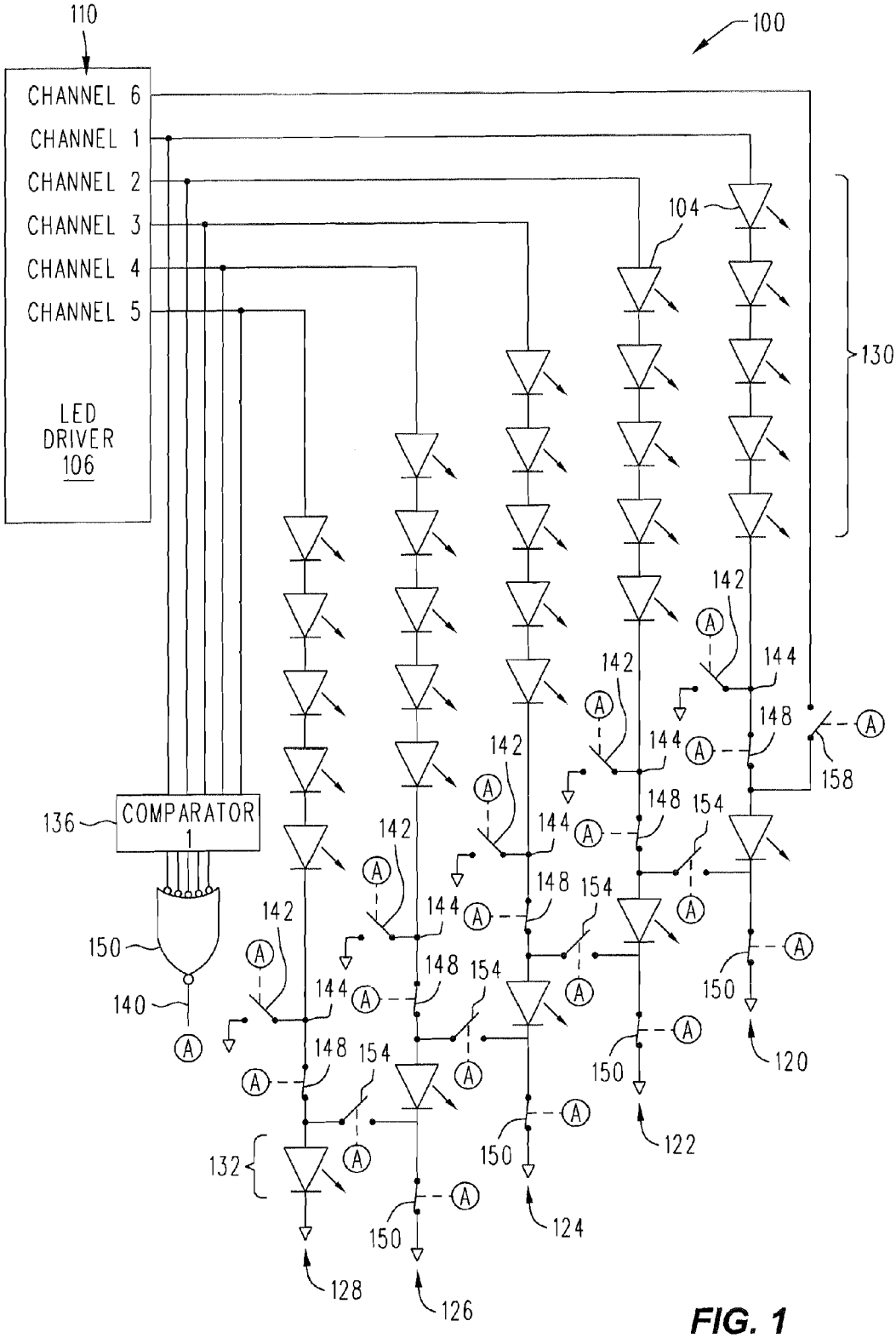
FIG. 1 is a schematic diagram of an embodiment of a light emitting device in a first state.

An embodiment of a light emitting device 100 is shown in FIG. 1. In summary, the light emitting device 100 emits light via a plurality of LEDs 104. In the embodiment of the light emitting device 100 described herein, thirty LEDs 104 are used. However, other embodiments may use different numbers of LEDs 104. The LEDs 104 are driven by a driver 106.

The LEDs 104 emit light when forward current is passed through them. A forward voltage is required to be applied to the LEDs 104 in order to generate a forward current. The forward voltage of the LEDs 104 may vary due to temperature and other variables. Thus, the voltage supplied by the driver 106 may have to increase in order to accommodate the increased forward voltage requirements. In conventional light emitting devices, the forward voltage of the LEDs may exceed the maximum output of the driver, which will cause the illumination of the LEDs 104 to diminish or may cause the LEDs to stop illuminating.

The driver 106 has a plurality of channels 110 wherein each channel is capable of driving a plurality of series LEDs. In the embodiment of the driver 106 described herein, the driver 106 has six channels 110 designated as channel 1 through channel 6. It is noted that the driver 106 may have any number of channels greater than one. The channels may be considered to be individual drivers and may be referenced herein as individual drivers. The channels 110 maintains a forward current through the LEDs 104 by adjusting their output voltage. However, the maximum voltage able to be output by the channels 110 is dependent on the supply voltage of the driver 106 along with other variables. Therefore, situations may arise wherein a channel voltage may not be able to be high enough to supply adequate current to illuminate series LEDs. The light emitting device 100 overcomes this problem as described below.

The LEDs 104 are connected in series, wherein some of the series connections may be in parallel with one another. The series connections of LEDs 104 are referred to herein as strings or pluralities of LEDs. The embodiment of the light emitter 100 of FIG. 1 has five strings of LEDs 104. The strings are referred to individually as the first string 120, the second string 122, the third string 124, the fourth string 126, and the fifth string 128. The strings are connected between the comparator 136 and a node, which in the embodiment of FIG. 1 is ground. The node is sometimes referred to as a reference voltage.

Each string has a first group 130 of LEDs and a second group 132 of LEDs. In the embodiment of FIG. 1, the second groups 132 have only one LED, however, they could have more LEDs than one. It is noted that the second groups 132 and the first groups 130 are connected in series via at least one switch or the like as described in greater detail below.

Channels 1-5 are connected to a comparator 136. It is noted that channel 6 is not connected to the comparator 136 or a string. The function of channel 6 will be described in greater detail below. The comparator 136 serves to determine if a channel voltage exceeds a predetermined value. In the embodiment of FIG. 1, the comparator 136 comprises an individual comparator for each channel and outputs a value for each channel. In other embodiments, the comparator 136 may output a value if any of the channel voltages exceed a preselected value. The outputs of the comparator 136 are connected to a switch 138, which in the embodiment of FIG. 1 is an exclusive nor gate (XNOR) 138. It is noted that devices other than the XNOR gate 138 may be used herein. The voltage at the output 140 of the switch 138, sometimes simply referred to as the output 140, changes when one of the channel voltages exceeds the preselected value. The output of the switch 138 toggles from a first voltage to a second voltage when a channel voltage exceeds the predetermined value.

Referring to the first string 120, which is substantially similar to the second through fourth strings 122-126, a first switch 142 is connected between a node 144 and ground. The first switches 142 are normally open. The term normally as referred to herein refers to a state of the light emitting device 100 when none of the channel voltages exceed the predetermined value. Accordingly, the switch 138 outputs the first voltage. The state of the first switches 142 are controlled by the switch 138. When the switch 138 outputs the first voltage, the first switches 142 are open. Likewise, when the switch 138 outputs the second voltage, the first switches 142 close.

Second switches 148 are connected between the first node 144 and the second group 132 of LEDs. Like the first switches 142, the second switches 148 are controlled by the output voltage of the switch 138. However, the second switches 148 are in the opposite state of the first switches 142. Therefore, when the switch 138 outputs the first voltage, the second switches 148 are closed. When the switch 138 outputs the second voltage, the second switches 148 are open.

Third switches 150 are connected between the second group 132 and ground and connect the second group 132 to ground when the third switches 150 are closed. When the third switches 150 are closed, the strings 120-128 consist of the first group 130 and the second group 132 of LEDs. As described in greater detail below, when the third switches 150 are open, the second group 132 of LEDs may form a sixth string. It is noted that the fifth string 238 does not have a third switch 150 associated therewith. As with the first switches 142 and the second switches 148, the third switches 150 are controlled by the switch 138. The third switches 150 are normally closed and are in the same state as the second switches 148.

Fourth switches 154 are connected between the strings 120-128. The fourth switches 154 are controlled via the switch 138 and are in an opposite state relative to the third switches 150. Therefore, when the third switches 150 are closed, the fourth switches 154 are open. It is noted that when the fourth switches 154 are closed, the anode of an LED on one string is connected to the cathode of an LED in another string.

A fifth switch 158 connects the sixth channel to the second group 132 of LEDs. In the embodiment of FIG. 1, the fifth switch 158 is connected between the sixth channel and the anode of an LED in the second group 132 of LEDs in the first string 120. The fifth switch 158 is controlled by the switch 138 and is in the same state as the first switches 142 and the fourth switches 154.

Having described the components of the light emitting device 100, the operation of the light emitting device 100 will now be described. In summary, the light emitting device 100 maintains all the LEDs 104 with enough forward voltage and/or current to remain illuminating when the forward voltage of one or more of the LEDs 104 increases. Thus, the intensity of light emitted by the light emitting device 100 remains substantially constant.

The embodiment of the light emitter 100 of FIG. 1 has thirty LEDs 104. Under normal conditions, the voltage 140 of the switch 138 causes the first switches 142, the fourth switches 154, and the fifth switch 158 to open. Likewise, the second switches 148 and the third switches 150 are closed. In this normal or first condition, the LEDs 104 are connected in series via the five strings 120-128.

In this first state, five strings 120-128 of LEDs 104 are connected to channels 1-5, wherein each of the five strings 120-128 consists of the first group 130 and the second group 132 of LEDs connected in series. In this state, each LED has a forward voltage that is low enough that to assure that all the LEDs 104 are able to produce light.

Events may occur that cause the forward voltage of one or more of the LEDs 104 to increase. For example, the temperature of the LEDs 104 may change the forward voltage. In order to meet the forward voltage requirements of the LEDs 104, the driver 106 outputs higher voltages on one or more of the channels 1-5. The output voltages of the channels 1-5 are monitored by the comparator 136 where they are compared to a predetermined voltage. The predetermined voltage may be close to the maximum voltage that the driver 106 or an individual channel is able to output. When this channel voltage is equal to or greater than the predetermined voltage, the comparator 136 changes. This voltage change causes the output 140 of the switch 138 to toggle from the first voltage to the second voltage.

Figure 2:
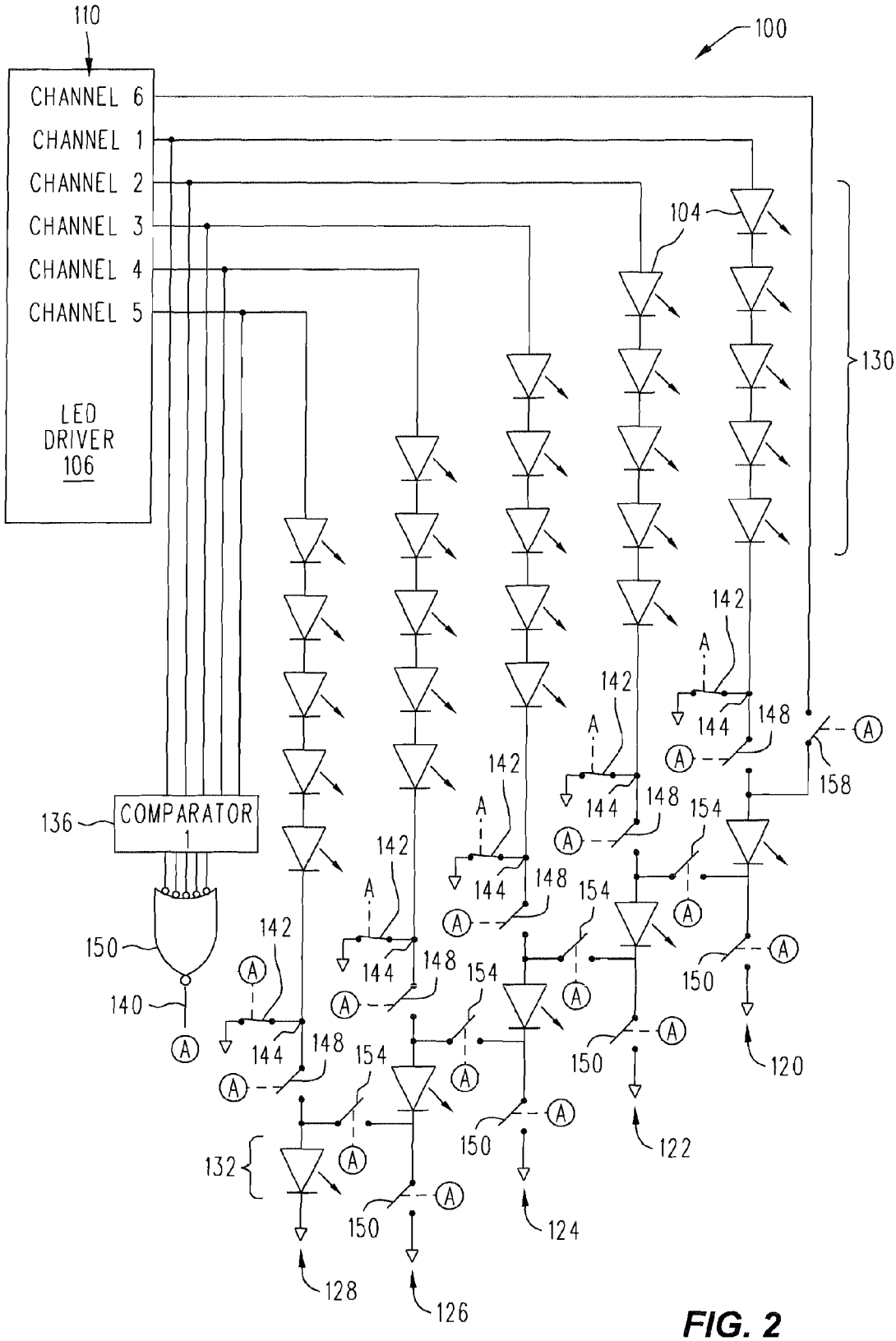
FIG. 2 is a schematic diagram of the light emitting device of FIG. 1 in a second state.

When the switch 138 outputs the second voltage, the switches change state, which yields the circuit of FIG. 2. FIG. 2 shows the light emitter 100 in a second state. In the second state, the first switches 142 are closed and the second switches 148 are open. Therefore, closed circuits are created from the channels 1-5, through the first group 130 of LEDs and to ground via the first switches 142. Therefore, the channels 1-5 only have to power the first group 130 of LEDs, which reduces the channel voltage they are required to produce.

In the second state, the third switches 150 are open and the fourth switches 154 are closed. In addition, the fifth switch 158 is closed. In the second state, the LEDs in the second group 132 are connected in series and powered by channel 6 of the driver 106. As shown in FIG. 2, each channel only drives five LEDs, which increases the probability that each channel can supply enough voltage to meet the increased forward voltages of the LEDs 104. The light emitting device 100 is able to maintain a substantially constant light source even if the forward voltages of the LEDs 104 increase above the supply maximum of the driver 106.

The light emitter 100 has been described as using LEDs 104. However, the use of LEDs is for illustration and other light sources may be used. The light emitter 100 has been described as using switches 142, 148, 150, 154, 158. Many different embodiment of switches may be used. For example, field effect transistors (FETs) or other electronic switches may be used. The comparator 136 described above compares each channel voltage to the predetermined voltage. In other embodiments, the comparator 136 may compare fewer channel voltages to the predetermined voltage. The switch 138 has been described as an exclusive NOR gate. In other embodiments, different devices may be used. For example, an OR gate may be used. In other embodiments, one channel voltage may be monitored and the output of the comparator 136 may be used to toggle the switches instead of using the switch 138.

What is claimed is:

1. A light emitting device comprising:

a first plurality of light emitters comprising a first group and a second group, wherein said first group is connectable in series to said second group;

a first driver connected to said first group;

a second driver connectable to said second group;

a first voltage comparator coupled to said first driver, wherein said voltage comparator compares the voltage of said first driver to a predetermined voltage;

wherein said light emitting device is in a first state when the voltage of said first driver is less than said predetermined voltage;

wherein said light emitting device is in a second state when the voltage of said first driver is greater than said predetermined voltage;

wherein when said light emitting device is in said first state, said first group is connected in series with said second group to form a series circuit between said first driver and a reference voltage; and wherein when said light emitting device is in said second state, said first group is connected between said first driver and said reference voltage and said second group is connected between said second driver and said reference voltage.

2. The light emitter of claim 1, wherein said first group of light emitters has a first end connected to said first driver and a second end connected to a first node, and further comprising a first switch connected between said first node and said reference voltage, wherein said first switch is open when said light emitting device is in said first state and wherein said first switch is closed when said light emitting device is in said second state.

3. The light emitter of claim 1 and further comprising a second switch connected between said first group and said second group, wherein said second switch is closed when said light emitting device is in said first state and wherein said second switch is open when said light emitting device is in said second state.

4. The light emitting device of claim 1, wherein said light emitters are light emitting diodes.

5. The light emitting device of claim 1, wherein said first group is connectable to said second group by way of a field effect transistor.

6. A light emitting device comprising:

a first plurality of light emitters comprising a first group and a second group, wherein said first group is connectable in series to said second group;

a second plurality of light emitters comprising a third group and a fourth group, wherein said third group is connectable in series to said fourth group, and wherein said second group is connectable in series to said fourth group;

a first driver connected to said first group;

a second driver connectable to said second group;

a third driver connectable to said third group;

a first voltage comparator coupled to said first driver, wherein said voltage comparator compares the voltage of said first driver to a predetermined voltage;

wherein said light emitting device is in a first state when the voltage of said first driver is less than said predetermined voltage;

wherein said light emitting device is in a second state when the voltage of said first driver is greater than said predetermined voltage;

wherein when said light emitting device is in said first state, said first group is connected in series with said second group to form a series circuit between said first driver and a reference voltage, and said third group is connected in series with said fourth group to form a series circuit between said third driver and said reference voltage; and wherein when said light emitting device is in said second state, said first group is connected between said first driver and said reference voltage, said third group is connected between said third driver and said reference voltage, and said second group and said fourth group are connected in series between said second driver and said reference voltage.

7. The light emitting device of claim 6 and further comprising a second voltage comparator coupled to said second driver, wherein said second voltage comparator compares the voltage of said second driver to a second predetermined voltage; wherein said light emitting device is in a first state when the voltage of said first driver is less than said predetermined voltage or the voltage of said second driver is less than said second predetermined voltage.

8. The light emitting device of claim 6 and further comprising a first switch connected between said first group and said voltage reference; wherein when said light emitting device is in said first state, said first switch is open; and wherein when said light emitting device is in said second state, said switch is closed creating a circuit between said first channel and said voltage reference, and through said first group.

9. The light emitting device of claim 6 and further comprising a second switch connected between said first group and said second group; wherein when said light emitting device is in said first state, said second switch is closed, creating a circuit between said first channel and said voltage reference, and through said first group and said second group; and wherein when said light emitting device is in said second state, said second switch is open.

10. The light emitting device of claim 6 and further comprising a third switch connected between said fourth group and said voltage reference; wherein when said light emitting device is in said first state, said third switch is closed; and wherein when said light emitting device is in said second state, said third switch is open.

11. The light emitting device of claim 6 and further comprising a fourth switch connected between said second group and said fourth group; wherein when said light emitting device is in said first state, said fourth switch is open; and wherein when said light emitting device is in said second state, said fourth switch is closed, creating a series circuit with said second group and said fourth group.

12. The light emitting device of claim 6 and further comprising a fifth switch connected between said fourth group and third channel; wherein when said light emitting device is in said first state, said fifth switch is open; and wherein when said light emitting device is in said second state, said fifth switch is closed.

13. The light emitting device of claim 6 and further comprising:

a first first switch connected between said first group opposite said first driver, and said voltage reference;

a second first switch connected between said third group opposite said second driver, and said voltage reference;

a first second switch connected between said first group and said second group;

a second second switch connected between said third group and said fourth group;

a third switch connected between said second group opposite said first group and said voltage reference;

a fourth switch connected between said second group and said fourth group; and a fifth switch connected between said third driver and said fourth group;

wherein when said light emitting device is in said first state, said first switches, said fourth switch, and said fifth switch are open and said second switches and said third switch are closed; and wherein when said light emitting device is in said second state, said first switches, said fourth switch, and said fifth switch are closed and said second switches and said third switch are open.

14. The light emitting device of claim 6, wherein at least one of said switches is a field effect transistor.

15. A method for controlling a light emitting device, said light emitting device comprising:

a first plurality of light emitters comprising a first group and a second group, wherein said first group is connectable in series to said second group;

a second plurality of light emitters comprising a third group and a fourth group, wherein said third group is connectable in series to said fourth group, and wherein said second group is connectable in series to said fourth group;

a first driver connected to said first group;

a second driver connectable to said second group; and a third driver connectable to said third group;

said method comprising:

monitoring the voltage of said first driver;

connecting said first group to said second group if the voltage of said first driver is below a preselected value;

connecting said third group to said fourth group is the voltage of said first driver is below said preselected value; and connecting said second group to said fourth group in series, wherein the series connection is connected to said third driver if the voltage of said first driver is above said preselected value.

16. The method of claim 15 and further comprising:

monitoring the voltage of said second driver;

connecting said first group to said second group if the voltage of said first driver and said second driver are below a preselected value;

connecting said third group to said fourth group is the voltage of said first driver and said second driver are below said preselected value; and connecting said second group to said fourth group in series, wherein the series connection is connected to said third driver if the voltage of said first driver or said second driver is above said preselected value.

* * * * *